US006913451B2

(12) United States Patent
Hedrick et al.

(10) Patent No.: US 6,913,451 B2
(45) Date of Patent: Jul. 5, 2005

(54) VACUUM PUMP WITH FAIL-SAFE VANES

(75) Inventors: Geoffrey S. M. Hedrick, Malvern, PA (US); Marlon Brown, West Chester, PA (US)

(73) Assignee: Innovative Solutions & Support Inc., Exton, PA (US)

( * ) Notice: Subject to any disclaimer, the term of this patent is extended or adjusted under 35 U.S.C. 154(b) by 0 days.

(21) Appl. No.: 10/725,975

(22) Filed: Dec. 2, 2003

(65) Prior Publication Data

US 2004/0136852 A1 Jul. 15, 2004

Related U.S. Application Data

(63) Continuation of application No. 10/269,117, filed on Oct. 11, 2002, now abandoned.

(51) Int. Cl.[7] ..... F01C 21/00
(52) U.S. Cl. ..... 418/2; 418/234; 418/259
(58) Field of Search ..... 418/2, 234, 259, 418/266–269

(56) References Cited

U.S. PATENT DOCUMENTS 3,301,194 A * 1/1967 Brunson ..... 418/2
3,627,456 A * 12/1971 Gerlach ..... 418/267
3,744,939 A * 7/1973 Grennan et al. ..... 418/30

FOREIGN PATENT DOCUMENTS

DE 2311168 A * 9/1974 ..... 418/267
FR 1078008 A * 5/1954 ..... 418/267
NO 100177 A * 7/1962 ..... 418/267

* cited by examiner

*Primary Examiner*—Theresa Trieu
(74) *Attorney, Agent, or Firm*—Cohen, Pontani, Lieberman & Pavane

(57) ABSTRACT

A vacuum vane pump for generating a vacuum condition for aircraft instruments includes a rotor having a peripheral surface eccentrically mounted in a housing having a confrontingly opposed inner surface so that the opposed surfaces define a crescent-shaped chamber. The rotor has a plurality of radial slots, each of which receives a vane which is slidably displaced radially outwardly along the slot as the rotor is rotatively driven so that the outer tips of the vanes are pressed in frictional abutment with the inner surface of the housing. Each slot has a radially inward facing shoulder and each vane has a corresponding radially outward facing shoulder for mutual contact engagement when the tip becomes worn to a predetermined degree. The vanes are thereby captured within their respective slots so that, as the tips wear down, a gap forms between each tip and the inner surface of the housing at the widest part of the chamber, resulting in a gradual loss of vacuum that indicates that the pump requires maintenance.

40 Claims, 2 Drawing Sheets

VACUUM PUMP WITH FAIL-SAFE VANES

CROSS REFERENCE TO RELATED APPLICATION

This application is a continuation of U.S. patent application Ser. No. 10/269,117 which was filed with the U.S. Patent and Trademark Office on Oct. 11, 2002, now abandoned.

BACKGROUND OF THE INVENTION

1. Field of the Invention

The present invention generally relates to a vane pump and, more particularly, to a vacuum vane pump for use on aircraft to generate a vacuum condition necessary for the operation of aircraft instrumentation.

2. Description of the Related Art

Sensitive analog guidance instrumentation and indicator displays such as gauges used on small aircraft and principally relied upon by aircraft pilots in the operation of such aircraft require a suitable operating environment to properly function. Such instrumentation are highly susceptible to variations in their operating environment and, in particular, to changes in barometric or cabin pressure which will affect, among other things, altimeter measurements and, hence, the gauge displays of such measurements. For these reasons, it is imperative that such guidance equipment and indicators operate in as close to a vacuum condition as practicable so that they provide a true indication of aircraft operating parameters.

Vane pumps are commonly used to generate the necessary vacuum for small aircraft instrumentation. With reference to FIG. 1, known vane pumps 5 typically consist of a rotor 10 secured for rotation with a motor-driven shaft 12 by a key 13. The rotor 10 has a peripheral surface 14 and is surrounded by a casing or housing 30 having an inward facing surface 32. Rotor 10 is mounted eccentrically in housing 30 so that its peripheral surface 14 and the confronting inner surface 32 of housing 30 define a crescent-shaped chamber 34 therebetween. The rotor also has a plurality of radially-extending slots 16 defined and extending between an inner end 17 and an outer end 19 coterminous with peripheral surface 14. A plurality of fingers or vanes 20 (five of which are shown by way of illustrative example) are slidably engageable in slots 16. Each vane 20 has an inner end 21 disposed proximate end 17 of its corresponding slot, and an outer tip 22 which as the vane 20 is radially-outwardly displaced along its slot 16 by the centrifugal force exerted on the vanes through rotation of rotor 10, is driven beyond outer end 19 and into pressed abutment against the internal surface 32 of housing 30. As rotation of the rotor causes vane tips 22 to pressingly advance circumferentially about the inner surface 32 of housing 30, the air or gas in the crescent-shaped chamber 34 is alternately compressed and expanded to create a vacuum.

In order to extend the resulting vacuum to the appropriate instruments in, for example, an aircraft cockpit, porting of vacuum chamber 34 is effected, as is known in the art, for example in the manner shown in U.S. Pat. No. 5,100,308 which also describes multiple stages and arrangements for changing the eccentricity of the rotor in the housing to enable regulation of the amount of vacuum or positive pressure generated by the vane pump. The slots and vanes need not be oriented in a strictly radial manner but may, instead, be skewed as for example disclosed in FIGS. 6 and 7 of U.S. Pat. No. 6,086,332.

The vanes 20 in a conventional vane pump of the type heretofore described and depicted in FIG. 1 are typically formed of carbon and the housing 30 is typically constructed of aluminum. During pump operation the vane tips 22 incur steady wear from friction as they press against and slidingly contact the inner housing surface 32 during rotation of rotor 10. Over time, the gradual wearing of the tips 22 causes shortening of the vanes relative to their respective slots 16, thus requiring that the vanes be displaced or travel farther radially outward along the slots; as a result, for each one the distance between inner slot end 17 and inner vane end 21 increases as the outer tip 22 continues to frictionally engage surface 32. Put another way, the length of each vane 20 that remains within its respective slot 16 as the vane tip 22 is centrifugally pressed against confronting housing wall surface 22 steadily decreases as the pump 5 is operated. Eventually, one or more of the vanes decrease in length to a point that its portion that extends out of its respective slot 16 approaches or exceeds in length the portion that remains within the slot. This condition commonly results in a sudden and catastrophic breaking or dislodging of one or more of the vanes from their respective slots in or about the widest part of chamber 34, causing an abrupt loss of vacuum. Often one broken vane initiates a catastrophic destruction of additional ones of vanes and, therefore, a complete loss of vacuum. Unexpected reduction or total loss of vacuum adversely affects instrumentation readings and can lead to erroneous decisions in controlling the aircraft. Even with a vacuum loss warning system, the information displayed to a pilot on the gauges is unreliable at best.

The long-accepted solution, according to the prior art, is regular scheduled maintenance of vane pumps through periodic disassembly to detect the extent of vane wear, a time consuming and costly procedure that, without early replacement of pumps typically capable of safely operating for additional extended periods of time, is an unreliable predictor of imminent pump failure.

SUMMARY OF THE INVENTION

It is therefore an object of the invention to provide an improved vane pump in which the likelihood of unexpected broken vanes and the resulting catastrophic loss of a vacuum condition caused by the vane pump is reduced.

In accordance with the invention, a vane pump is provided for creating a vacuum condition in a pump chamber formed between a housing wall and a rotor. The rotor has a plurality of slots, each containing a vane slidably engageable within the respective slot. The vanes are radially outwardly displaced by centrifugal force as the rotor is operatively rotated in that the leading edges of the vanes are outwardly advanced from the respective slot mouths or openings into pressed contact with the housing wall. The vanes and slots are configured to capture within the slots a stop or obstruction carried on the radially inner end of each vane and thereby limit the radial displacement of the vanes beyond the slot openings or mouths. This construction thereby prevents or notably reduces the possibility of vane breakage within the chamber and, hence, prevents an abrupt catastrophic loss of vacuum.

In a preferred embodiment, the stop is created by forming a unitary flange on an engagement region of each vane, such as at or proximate an inner end of each vane, for engagement with a protrusion, shoulder or other obstruction positioned at a predetermined location relative to the slot opening. As the vanes erode or decrease in length through continued frictional contact with the housing wall, a gradual, rather than an abrupt, decrease or loss of vacuum pressure can be detected, indicating that immediate maintenance or servicing of the vane pump is required.

In another embodiment, a switch is activated to trigger an alarm or service indicator when a predetermined amount of wear has occurred on one or more of the pump vanes to signal that immediate pump maintenance is required.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals indicate similar elements throughout the several views.

DETAILED DESCRIPTION OF THE PRESENTLY PREFERRED EMBODIMENTS

Figure 1:
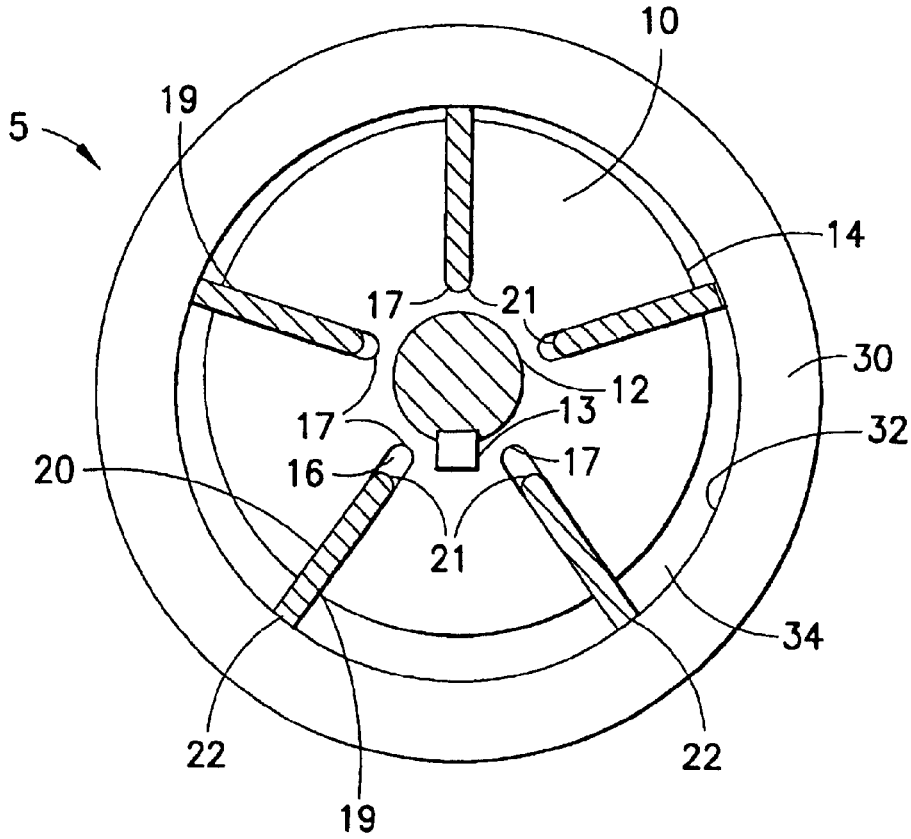
FIG. 1 PRIOR ART
FIG. 1 is a cross-section of a vane pump according to the prior art.
Figure 2:
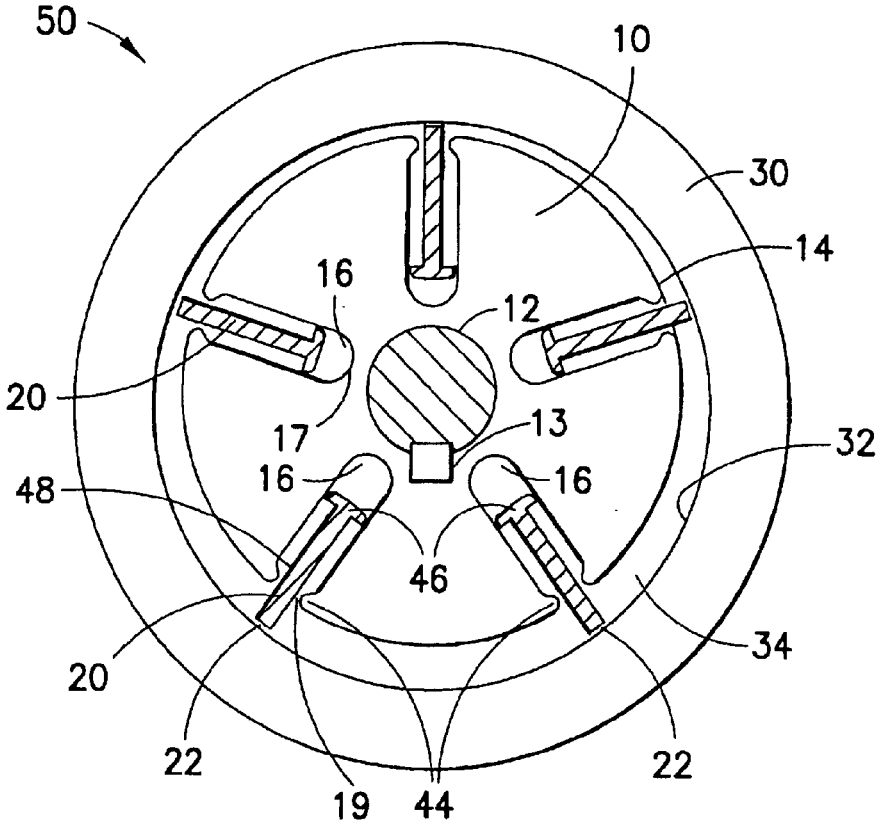
FIG. 2 is a cross-section of a vacuum vane pump in accordance with a preferred embodiment of the present invention.

A vacuum vane pump 50 constructed in accordance with the present invention is shown in FIG. 2. Like the prior art vane pump 5 of FIG. 1, pump 50 has a rotor 10 eccentrically aligned within a housing 30 and rotatable with respect thereto about a keyed shaft 12. The rotor has a plurality of slots 16 formed therein, with each slot occupied by a vane 20 dimensioned or profiled for sliding movement along a respective slot and partially outwardly therefrom through a slot opening or mouth 19. As explained above, as rotor 10 is rotated by shaft 12, the centrifugal force acting on the radially slidable vanes 20 displaces the vanes radially outward from shaft 12 so that the leading edges 22 of the vanes are driven beyond the slot openings 19 into pressed frictional abutment with the inner surface 32 of housing 30. The vanes act as wipers that force air along the eccentrically-shaped chamber 34 to create a vacuum condition.

Unlike the prior art pump of FIG. 1, the inventive pump 50 is configured with a safety feature effective to prevent over-extension of the vanes 20 into chamber 34. Without this safety feature, the vanes will continue to gradually wear away and shorten due to their frictional sliding engagement with inner housing wall 32 until the vanes either dislodge from the slots 16 or break off or facture within chamber 34. When a vane pump is used to provide critical operating vacuum to aircraft cockpit instrumentation and indicators, the sudden and complete loss of vacuum that typically results from vane dislodgement or breakage can lead to critical pilot error as the instrument indicators become disabled or unreliable.

Figure 3:
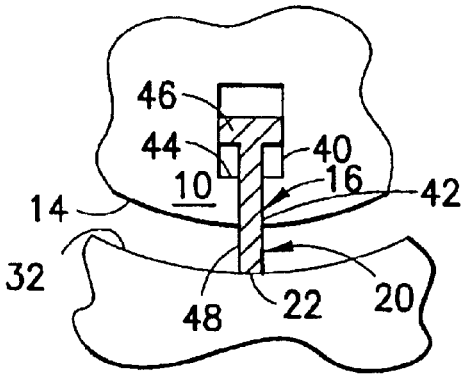
FIG. 3 is a partial cross-section of a rotor in the pump of FIG. 2, prior to significant wear of the vane tip.
Figure 4:
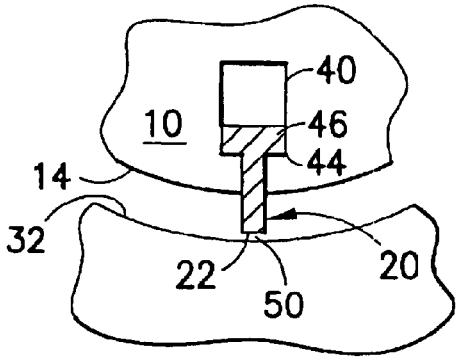
FIG. 4 is a partial cross-section of a rotor in the pump of FIG. 2 when the vane tip is fully worn.

In accordance with a preferred embodiment of the invention, the safety feature includes a reconfigured vane having a narrow elongated shaft portion 48 and an engagement region such as a head portion 46, which may, for example, be disposed at or proximate the radially innermost end of the vane 20 as shown in FIGS. 2–4. The slots 16 are configured to define a similarly narrow mouth or opening 19, as by forming a shoulder 44 in the slot walls, the opening 19 being dimensioned to allow sliding movement therethrough of shaft 48 but to obstruct and prevent passage of the wider head portion 46. In this manner, the vane head 46 serves as an anchor for vane-capturing abutment against slot shoulder 44. Thus, as the outer tips 22 of the vanes continue to gradually wear and erode through frictional contact against the inner surface 32 of the chamber during manual operation of the pump, the vanes are prevented from entirely exiting their slots and thereby initiating a catastrophic failure of the pump. Moreover, as the vanes wear down and are unable to become radially outwardly displaced beyond that permitted by the abstract of the head portion 46 and slot shoulder 44, a gap 50 will develop between the tips 22 and the chamber wall and result in a gradual reduction in the level of vacuum pressure. In this manner, a pilot of an aircraft in which the pump is operating will be alerted by the decreased vacuum that maintenance is required.

Other slot and vane configurations and modification can be employed and will be apparent to those having ordinary skill in the art for capturing the vanes and preventing them from completely exiting from their corresponding slots. Thus, the vanes 20 depicted in FIGS. 2 to 4 can be implemented using a wide variety of shapes whereby the vane head 46 is variously configured and positioned at different locations on or along the elongated vane. For example, the head 46 can be formed as a circumferential projection or ring that is located in predeterminately spaced relation from the radially inwardly-disposed end of the vane, rather than closely proximate or at that inward end as shown in FIGS. 2 to 4. Similarly, the contours and shaping of the projection or head 46 can take on any convenient form as a general matter of manufacturing efficiency and design choice. Thus, the vane head may by way of illustration be alternatively implemented as a selected plurality of laterally extending arms on the vane. In a similar manner, the implementation of the slot shoulder or the like for engagement with the vane head can be varied from that herein described, as for example by differently shaping or contouring or locating the slot shoulder or by defining the same as a separate element, such as a band or ring or the like, that is press-fit into or otherwise anchored to the slot for engagement with the vane head to capture the vane within the slot. The nature and extent of all such modifications are limited only by the requirement that the head 46—of whatever form and/or location on or along the vane—be cooperatively engageable with a shoulder or other structure or wall shaping or contour that is defined along and/or as an integral or attached part of the vane slot so that the vane is captively prevented from fully exiting and thereby becoming entirely free and clear of the slot, and/or so that the vane cannot be outwardly displaced along the slot by centrifugal force beyond a predetermined point at which that longitudinal portion of the vane remaining within the slot is insufficient to maintain the radially-outwardly extending portion of the vane in the desired orientation in which its outer tip 22 is disposed in confronting opposition to the housing wall surface 32. It is also within the contemplation of the invention that the vane slots be so defined in the rotor the vanes positioned therein are not radially aligned with the rotor shaft 12.

Figure 5:
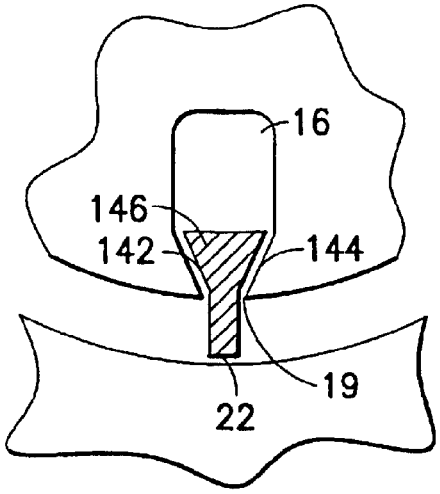
FIG. 5 is a partial cross-section of a rotor in accordance with another embodiment of the present invention.

Another vane construction is shown by way of example in FIG. 5. There, a vane head 146 having a tapered sidewall 142 may be mounted within a rotor slot 116 having an opposingly defined wall 144 for mating engagement with the vane sidewall 142 as the vane erodes at its leading tip to captively prevent dislodgement of the vane from within the slot.

Figure 6:
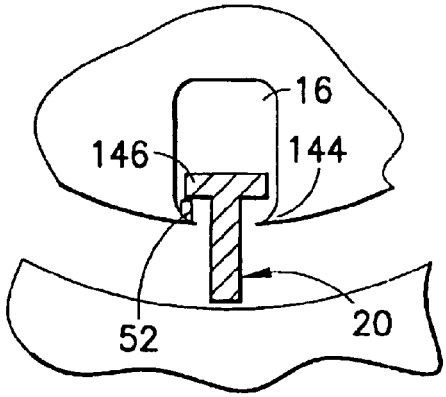
FIG. 6 is a partial cross-section of a rotor according to still another invention embodiment of the invention.

In still another embodiment of the invention shown in FIG. 6, a vane erosion indicator arrangement is implemented by positioning a contact switch 52 between the slot shoulder 144 and the vane head 146 so that, when the vane erodes to a predetermined extent, the head portion 46 engages and actuates switch 52 to operating an alerting signal, such as an indicator light, audible alarm, etc., in a known manner to inform a pilot or other user or operator that the pump is in need of maintenance or replacement. Although the switch is shown in FIG. 6 as mounted to the slot shoulder 144, it could alternatively be positioned elsewhere on the rotor or carried on the vane or in any other suitable location for actuation when the vane has become predeterminately worn.

Under ideal conditions, all of the vanes should experience through normal vane pump operation, substantially the same amount of erosion over time. Thus, a single switch 52 positioned for engagement with a selected one of the vanes may suffice to provide an appropriate vane pump erosion indicator. In reality, of course, variations in material characteristics and numerous other factors cause the vanes to wear, as their tips frictionally slide along the opposed housing inner wall surface, at rates that are at least slightly or marginally different. Indeed, such variations from vane to vane in the rate of wear are both expected and desired to result in only a relatively small and gradual decrease in the vacuum generated by the vane pump as the captive vanes variously wear down to predetermined points at which their individual tips at first no longer sealingly press against, and then define a gap with, the housing inner wall surface. It is accordingly preferred that an indicator switch or the like is provided for activation by each of the vanes as its outward tip wears down to the predetermined extent, or alternatively that an other detection arrangement is employed to detect the predetermined threshold wear of each vane of the inventive vane pump.

While there have shown and described and pointed out fundamental novel features of the invention as applied to preferred embodiments thereof, it will be understood that various omissions and substitutions and changes in the form and details of the methods described and the systems and components and devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. In a vane pump operable for generating a vacuum and including a rotor mounted for rotation within a housing to define an eccentric chamber between a peripheral edge of the rotor and an inner wall surface of the housing, the rotor including a plurality of slots extending inwardly from the peripheral edge and the vane pump further including a plurality of elongated vanes each disposed in a respective one of the slots for outward sliding movement of the vanes in and along the slots from a nonoperating position in which an outer end of each vane is disposed in spaced relation to the housing inner wall surface and an operating position in which the outer end of each vane is disposed in contact with the inner wall surface by centrifugal force acting on the vanes as the rotor is rotated within the housing during vacuum-generating operation of the vane pump, the improvement comprising:

a first stop on each of the slots; and a second stop located on each of the vanes for releasable engagement with the first stop of the respective slot to capture through said releasable engagement at least a longitudinal inner portion of each vane within the respective slot, said first and second stops being positioned on the slots and vanes so that, as frictional contact of the each vane outer end with the housing inner wall surface as the vane pump is operated causes gradual wear-based erosion of the each vane outer end to thereby longitudinally shorten the each vane and require added centrifugal force-induced outward sliding movement of the each vane from the first to the second position for attaining contact of the each vane outer end with the housing inner wall surface, the engagement of the first and second stops prevents continued outward sliding movement of the each vane beyond a predetermined point to maintain the at least a longitudinal inner portion of the each vane within the respective slot, wherein each said vane comprises a tapered sidewall that defines said second stop.

2. In a vane pump in accordance with claim 1, wherein said first stop on each said slot comprises a shoulder integrally defined on a wall of said each slot.

3. In a vane pump in accordance with claim 2, wherein said second stop on each said vane comprises a shoulder integrally defined on a wall of said each vane.

4. In a vane pump in accordance with claim 1, wherein each said slot comprises a tapered sidewall that defines said first stop.

5. In a vane pump in accordance with claim 1, further comprising a sensor for detecting engagement of said first and second stops.

6. In a vane pump in accordance with claim 5, wherein said sensor comprises a switch mounted for actuation by said engagement of the first and second stops.

7. In a vane pump in accordance with claim 1, wherein each said slot is substantially radially aligned with an axis of rotation of the rotor.

8. In a vane pump in accordance with claim 1, wherein said first stop comprises a constriction defined in each said slot proximate said rotor peripheral surface.

9. In a vane pump in accordance with claim 1, wherein engagement of said first and second stops define an outward position of an outer tip of one of said slots, said vane pump further comprising a sensor for detecting when said outward position is reached.

10. A vane pump operable for generating a vacuum, comprising:

a housing having an inner wall surface;

a rotor having a peripheral edge and mounted for rotation within said housing to define an eccentric chamber between said peripheral edge and said housing inner wall surface, said rotor including a plurality of slots defined about the rotor, each of said slots extending inwardly from said peripheral edge and including a first stop defined on said each slot; and a plurality of elongated vanes each disposed in a respective one of said slots for outward sliding movement of the vanes, by centrifugal force acting on the vanes as the rotor is rotated within the housing during vacuum-generating operation of the vane pump, in and along the slots from a nonoperating position in which an outer end of each vane is disposed in spaced relation to the housing inner wall surface and an operating position in which the outer end of each vane is disposed in contact with the inner wall surface;

each of said vanes having a tapered sidewall that defines a second stop located on said each vane for releasable engagement with the first stop of the respective slot to capture through said releasable engagement at least a longitudinal inner portion of each vane within the respective slot;

said first and second stops being positioned on the slots and vanes so that, as frictional contact of the each vane outer end with the housing inner wall surface as the vane pump is operated causes gradual wear-based erosion of the each vane outer end to thereby longitudinally shorten said each vane and require added centrifugal force-induced outward sliding movement of said each vane along the respective slot from the first to the second position for attaining contact of the each vane outer end with the housing inner wall surface, said engagement of the first and second stops prevents continued outward sliding movement of the each vane beyond a predetermined point to maintain said at least a longitudinally inner portion of the each vane within the respective slot.

11. A vane pump in accordance with claim 10, wherein said first stop on each said slot comprises a shoulder integrally defined on a wall of said each slot.

12. In a vane pump in accordance with claim 11, wherein said second stop on each said vane further comprises a shoulder integrally defined on a wall of said each vane.

13. In a vane pump in accordance with claim 10, wherein each said slot comprises a tapered sidewall that defines said first stop.

14. In a vane pump in accordance with claim 10, further comprising a sensor for detecting engagement of said first and second stops.

15. In a vane pump in accordance with claim 10, wherein said sensor comprises a switch mounted for actuation by said engagement of the first and second stops.

16. In a vane pump in accordance with claim 10, wherein each said slot is substantially radially aligned with an axis of rotation of the rotor.

17. In a vane pump in accordance with claim 10, wherein said first stop comprises a constriction defined in each said slot proximate said rotor peripheral surface.

18. In a vane pump in accordance with claim 10, wherein engagement of said first and second stops define an outward position of an outer tip of one of said slots, said vane pump further comprising a sensor for detecting when said outward position is reached.

19. In a vane pump operable for generating a vacuum and including a rotor mounted for rotation within a housing to define an eccentric chamber between a peripheral edge of the rotor and an inner wall surface of the housing, the rotor including a plurality of slots extending inwardly from the peripheral edge and the vane pump further including a plurality of elongated vanes each disposed in a respective one of the slots for outward sliding movement of the vanes in and along the slots from a nonoperating position in which an outer end of each vane is disposed in spaced relation to the housing inner wall surface and an operating position in which the outer end of each vane is disposed in contact with the inner wall surface by centrifugal force acting on the vanes as the rotor is rotated within the housing during vacuum-generating operation of the vane pump, the improvement comprising:

a first stop on each of the slots;

a second stop located on each of the vanes for releasable engagement with the first stop of the respective slot to capture through said releasable engagement at least a longitudinal inner portion of each vane within the respective slot, said first and second stops being positioned on the slots and vanes so that, as frictional contact of the each vane outer end with the housing inner wall surface as the vane pump is operated causes gradual wear-based erosion of the each vane outer end to thereby longitudinally shorten the each vane and require added centrifugal force-induced outward sliding movement of the each vane from the first to the second position for attaining contact of the each vane outer end with the housing inner wall surface, the engagement of the first and second stops prevents continued outward sliding movement of the each vane beyond a predetermined point to maintain the at least a longitudinal inner portion of the each vane within the respective slot; and a sensor for detecting engagement of said first and second stops.

20. In a vane pump in accordance with claim 19, wherein said first stop on each said slot comprises a shoulder integrally defined on a wall of said each slot.

21. In a vane pump in accordance with claim 20, wherein said second stop on each said vane comprises a shoulder integrally defined on a wall of said each vane.

22. In a vane pump in accordance with claim 19, wherein each said slot comprises a tapered sidewall that defines said first stop.

23. In a vane pump in accordance with claim 19, wherein said sensor comprises a switch mounted for actuation by said engagement of the first and second stops.

24. In a vane pump in accordance with claim 19, wherein each said slot is substantially radially aligned with an axis of rotation of the rotor.

25. In a vane pump in accordance with claim 19, wherein said first stop comprises a constriction defined in each said slot proximate said rotor peripheral surface.

26. A vane pump operable for generating a vacuum, comprising:

a housing having an inner wall surface;

a rotor having a peripheral edge and mounted for rotation within said housing to define an eccentric chamber between said peripheral edge and said housing inner wall surface, said rotor including a plurality of slots defined about the rotor, each of said slots extending inwardly from said peripheral edge and including a first stop defined on said each slot;

a plurality of elongated vanes each disposed in a respective one of said slots for outward sliding movement of the vanes, by centrifugal force acting on the vanes as the rotor is rotated within the housing during vacuum-generating operation of the vane pump, in and along the slots from a nonoperating position in which an outer end of each vane is disposed in spaced relation to the housing inner wall surface and an operating position in which the outer end of each vane is disposed in contact with the inner wall surface;

each of said vanes including a second stop located on said each vane for releasable engagement with the first stop of the respective slot to capture through said releasable engagement at least a longitudinal inner portion of each vane within the respective slot; and a sensor for detecting engagement of said first and second stops;

said first and second stops being positioned on the slots and vanes so that, as frictional contact of the each vane outer end with the housing inner wall surface as the vane pump is operated causes gradual wear-based erosion of the each vane outer end to thereby longitudinally shorten said each vane and require added centrifugal force-induced outward sliding movement of said each vane along the respective slot from the first to the second position for attaining contact of the each vane outer end with the housing inner wall surface, said engagement of the first and second stops prevents continued outward sliding movement of the each vane beyond a predetermined point to maintain said at least a longitudinally inner portion of the each vane within the respective slot.

27. In a vane pump in accordance with claim 26, wherein said first stop on each said slot comprises a shoulder integrally defined on a wall of said each slot.

28. In a vane pump in accordance with claim 27, wherein said second stop on each said vane comprises a shoulder integrally defined on a wall of said each vane.

29. In a vane pump in accordance with claim 26, wherein each said vane comprises a tapered sidewall that defines said second stop.

30. In a vane pump in accordance with claim 29, wherein each said slot comprises a tapered sidewall that defines said first stop.

31. In a vane pump in accordance with claim 26, wherein said sensor comprises a switch mounted for actuation by said engagement of the first and second stops.

32. In a vane pump in accordance with claim 26, wherein each said slot is substantially radially aligned with an axis of rotation of the rotor.

33. In a vane pump in accordance with claim 26, wherein said first stop comprises a constriction defined in each said slot proximate said rotor peripheral surface.

34. In a vane pump operable for generating a vacuum and including a rotor mounted for rotation within a housing to define an eccentric chamber between a peripheral edge of the rotor and an inner wall surface of the housing, the rotor including a plurality of slots extending inwardly from the peripheral edge and the vane pump further including a plurality of elongated vanes each disposed in a respective one of the slots for outward sliding movement of the vanes in and along the slots from a nonoperating position in which an outer end of each vane is disposed in spaced relation to the housing inner wall surface and an operating position in which the outer end of each vane is disposed in contact with the inner wall surface by centrifugal force acting on the vanes as the rotor is rotated within the housing during vacuum-generating operation of the vane pump, the improvement comprising:

a first stop on each of the slots; and a second stop located on each of the vanes for releasable engagement with the first stop of the respective slot to capture through said releasable engagement at least a longitudinal inner portion of each vane within the respective slot, said first and second stops being positioned on the slots and vanes so that, as frictional contact of the each vane outer end with the housing inner wall surface as the vane pump is operated causes gradual wear-based erosion of the each vane outer end to thereby longitudinally shorten the each vane and require added centrifugal force-induced outward sliding movement of the each vane from the first to the second position for attaining contact of the each vane outer end with the housing inner wall surface, the engagement of the first and second stops prevents continued outward sliding movement of the each vane beyond a predetermined point to maintain the at least a longitudinal inner portion of the each vane within the respective slot, wherein at least one of said first stop and said second stop comprises a tapered sidewall.

35. In a vane pump in accordance with claim 34, wherein said first stop comprises a shoulder integrally defined on a wall of at least one of said slots.

36. In a vane pump in accordance with claim 35, wherein said second stop comprises a shoulder integrally defined on a wall of a vane corresponding to said at least one slot.

37. In a vane pump in accordance with claim 34, wherein said slot corresponding to said at least one vane comprises a tapered sidewall that defines said first stop.

38. In a vane pump in accordance with claim 34, wherein engagement of said first and second stops define an outward position of an outer tip of one of said slots, said vane pump further comprising a sensor for detecting when said outward position is reached.

39. In a vane pump in accordance with claim 38, wherein said sensor comprises a switch.

40. In a vane pump in accordance with claim 34, wherein each said slot is substantially radially aligned with an axis of rotation of the rotor.

* * * * *